US005110179A

United States Patent [19]

Rogers

[11] Patent Number: 5,110,179

[45] Date of Patent: May 5, 1992

[54] RECLINER CHAIR

[76] Inventor: Walter C. Rogers, P.O. Box 685, Denton, N.C. 27239

[21] Appl. No.: 696,005

[22] Filed: May 6, 1991

Related U.S. Application Data

[60] Division of Ser. No. 463,461, Jan. 11, 1990, which is a continuation-in-part of Ser. No. 361,309, Jun. 5, 1989, Pat. No. 4,915,444.

[51] Int. Cl.[5] ..... A47C 1/02

[52] U.S. Cl. ..... 297/68; 297/75; 297/85

[58] Field of Search ..... 297/85, 65, 78, 69

[56] References Cited

U.S. PATENT DOCUMENTS

| | | | |
|---|---|---|---|
| 942,817 | 12/1909 | Flindall | 297/69 |
| 3,103,381 | 9/1963 | Schliephacke | 297/84 |
| 3,244,448 | 4/1966 | Re | 297/85 |
| 3,781,060 | 12/1973 | Pentzien | 297/68 |
| 3,980,335 | 9/1976 | Marhefka | 297/68 |
| 4,570,996 | 2/1986 | Rogers | 297/85 |
| 4,572,573 | 2/1986 | Yoshikawa et al. | 297/75 |
| 4,678,229 | 7/1987 | Ryan et al. | 297/68 |
| 4,790,599 | 12/1988 | Goldman | 297/68 |
| 4,915,444 | 4/1990 | Rogers, Jr. | 297/68 |

FOREIGN PATENT DOCUMENTS

| | | | |
|---|---|---|---|
| 3625824 | 11/1988 | Fed. Rep. of Germany | 297/68 |

*Primary Examiner*—Peter A. Aschenbrenner
*Attorney, Agent, or Firm*—William E. Mouzavires

[57] ABSTRACT

A recliner has a layer of upholstery fixed to the seat and extending continuously and fixed to the footrest frame which is moveable to a retracted position below and rearwardly of the front end of the seat with the upholstery extending about and under the front end of the seat. In one embodiment the footrest frame includes two ottoman boards mounted to a footrest linkage which includes a five bar linkage for actuating the ottoman boards. Additionally, a pair of locking links are mounted to the footrest linkage and connected to each other for releasably holding the footrest linkage in retracted position.

3 Claims, 6 Drawing Sheets

RECLINER CHAIR

RELATED APPLICATION

This application is a continuation of my prior copending application Ser. No. 07/463,461 filed Jan. 11, 1990 and entitled Recliner Chair which in turn is a continuation in part of application Ser. No. 07/361,309 filed June 5th, 1989, now U.S. Pat. No. 4,915,444 and entitled Recliner Chair.

OBJECTS OF THE INVENTION

The present invention relates to recliner chairs and more specifically to a recliner chair having a novel footrest system including several improvements.

An object of the present invention is to provide a novel and improved footrest system for a recliner chair. Included herein is a recliner chair incorporating such a footrest system.

Another object of the present invention is to provide a recliner chair having a novel footrest arrangement providing a continuous leg and foot support surface between the seat and the footrest proper and which, at the same time, allows the footrest to be moved to a retracted position located below the seat and rearwardly of the front end of the seat with the upholstery extending about the front and then under the seat.

Another object of the present invention is to provide a footrest system incorporating an improved linkage for extending and retracting the footrest.

A further object of the present invention is to provide a recliner chair having an improved lock mechanism for releasably holding the chair in closed or generally upright position with the footrest retracted Included herein is a novel footrest linkage incorporating a lock mechanism for releasably holding the footrest in retracted position.

DRAWINGS

Other objects and advantages of the present invention will become apparent from the following more detailed description taken in conjunction with the drawings in which.

SUMMARY OF INVENTION

In summary the present invention provides a leg and footrest support in a recliner chair which support extends from the seat to the footrest while wrapping or curling or convexly extending around the front of the seat when the chair is in closed position. Also, in that position the footrest linkage is located generally between a portion of the footrest frame ("ottoman board") and the seat.

The present invention also provides an improved linkage mounting the footrest for movement between retracted and extended positions. This linkage includes a five bar linkage allowing a portion of the footrest frame or ottoman board to be used to wrap the upholstery about and under the front of the seat and yet allows the ottoman board to be moved to extended or retracted position without striking the floor or requiring a greater seating height or shortening of footrest extension.

In addition the footrest system of the present invention incorporates a lock mechanism in the footrest linkage for releasably locking the footrest and in turn the chair in the closed (or generally upright) position with the footrest retracted.

DETAILED DESCRIPTION

Figure 1:
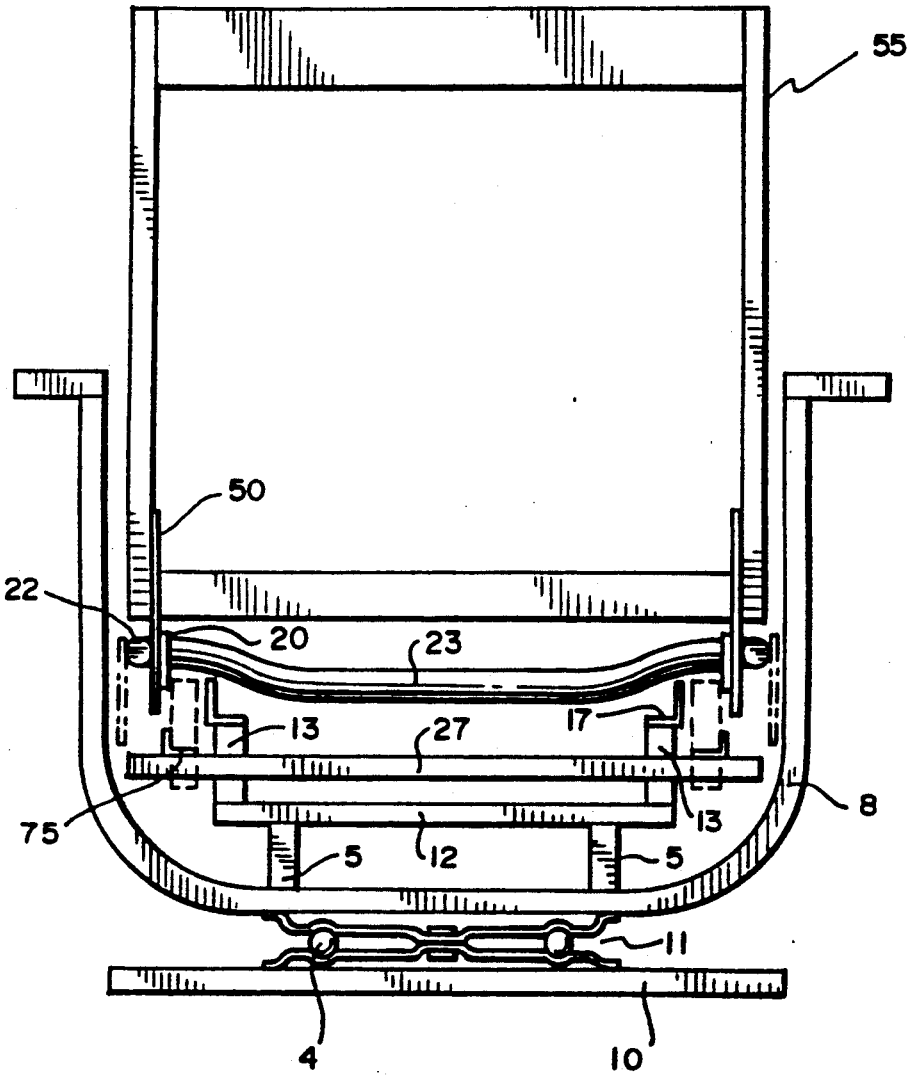
FIG. 1 is a front elevational view of a reclining chair embodying the present invention and with its upholstery removed.
Figure 2:
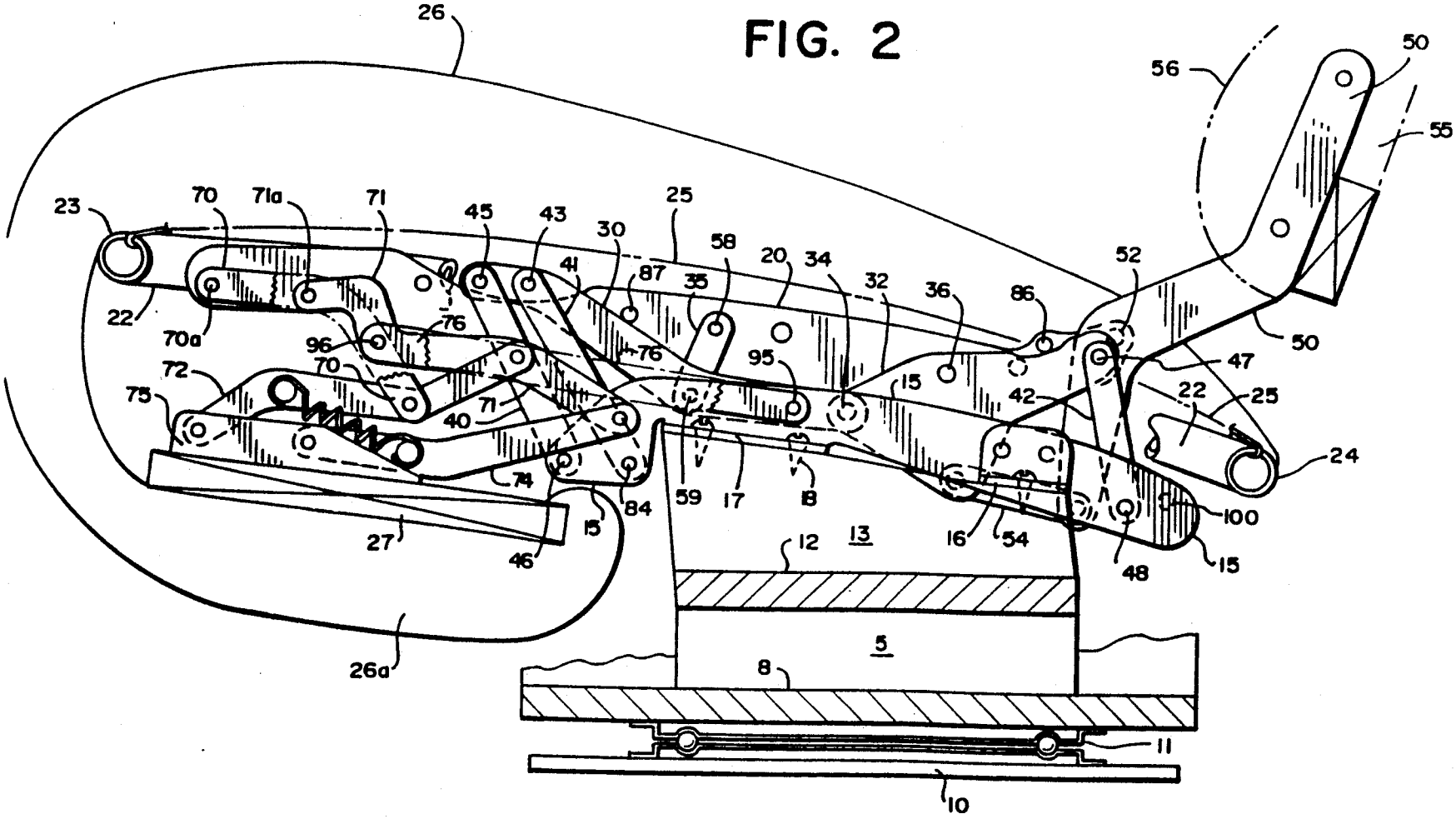
FIG. 2 is a side elevational view of the chair when in the closed or generally upright position and with portions of the backrest and links broken away.

Referring to FIGS. 1 and 2, a recliner chair embodying the present invention includes a base 10, an armrest frame 8 mounted on base 10 by a swivel assembly 11 including ball bearing 9. Armrest frame 8 includes a cross member or stretcher 12 extending between opposite sides thereof and fixed on blocks 5 which are fixed on the base of the armrest frame. Fixed on the stretcher 12 are a pair of laterally spaced mounting blocks 13 for mounting a base link 15 by means of flanges 16 and 17 and screws 18 as shown in FIG. 2.

Base link 15 extends in the forward-rearward direction of the chair and supports front and rear carrier links 30, 32 by means of mounting links 40 and 42 each pivotally interconnected at its opposite ends to a carrier link and base link such that the carrier links are swingable relative to the fixed base link. In this regard, link 40 is pivoted at 45 and 46 to carrier and base links 30 and 15 while link 42 is pivoted at 47 and 48 to carrier and base links 32 and 15. Carrier links 30, 32 are also pivotally connected to each other at pivot 34.

Carrier links 30, 32 support the seat of the chair which seat includes a seat link 20 extending in the forward-rearward direction of the chair where it is fixed to the seat frame including side tubes 22 and front and rear cross tubes 23, 24 made of structural steel in the specific embodiment shown. The seat link is mounted to the front carrier link 30 by means of a link 35 pivotally connected therebetween at pivots 58 and 59. Seat link 20 is pivotally mounted by pivot 36 directly to the rear carrier link 32.

The seat of the chair includes, in the shown embodiment, a sinuous wire layer 25 extending between the seat frame and a layer of upholstery 26 which may include a foam cushion layer and other conventional upholstery materials. However, in accordance with one of the features of the invention, the upholstery layer is attached to the seat frame and extends continuously from the seat to the footrest frame 26 (which in the art is at times referred to as "ottoman board") to which it is attached and which extends below the front of the seat in a generally horizontal plane such that the upholstery **26*a* at the front of the seat wraps or curls around and under the front of the seat as shown in FIG. 2**. Moreover, the linkage is arranged such that when the footrest is extended, the upholstery layer will extend continuously without sagging between the seat and footrest to provide a continuous contoured leg support surface.

Figure 3:
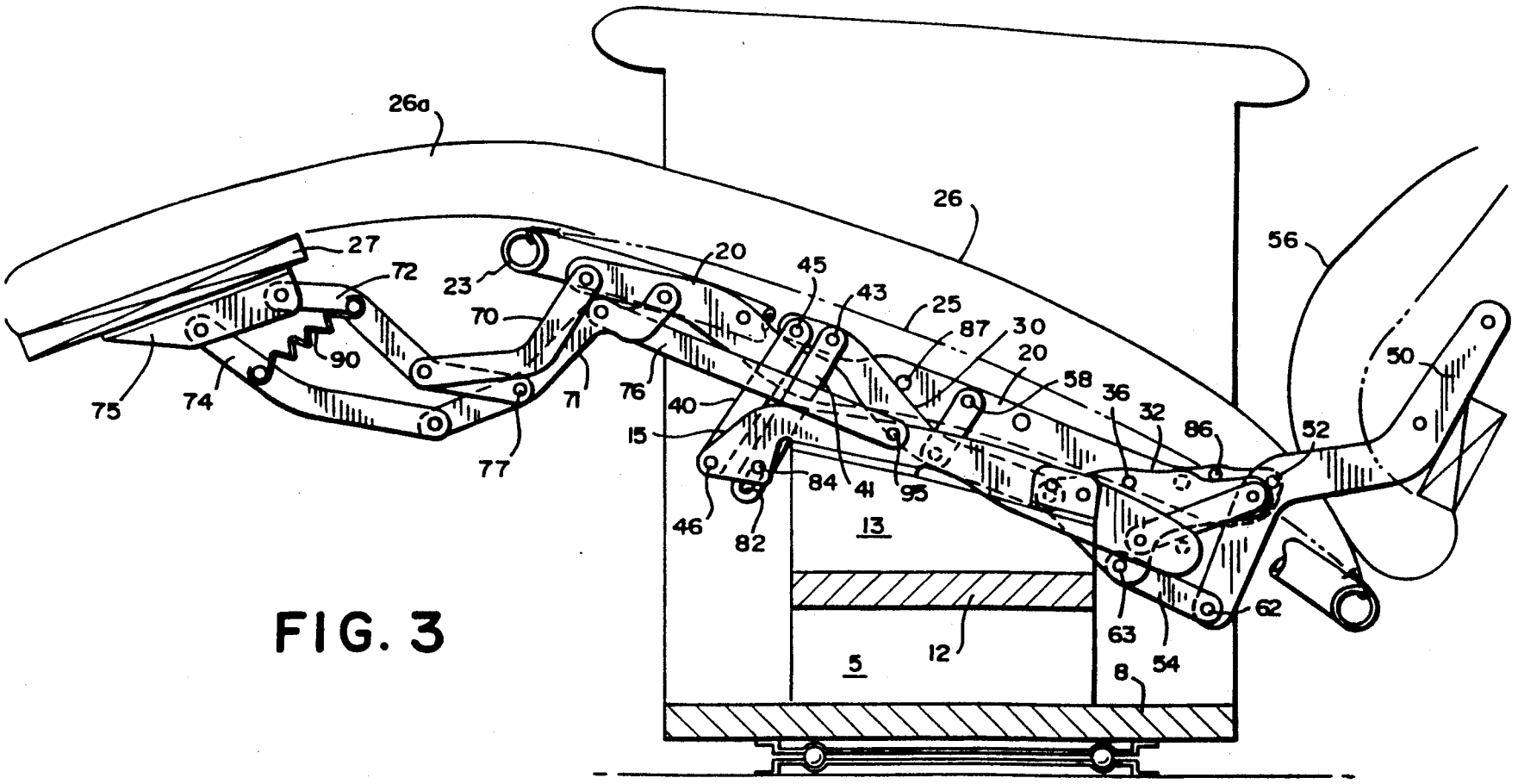
FIG. 3 is a view generally similar to FIG. 2 but with the chair shown in the TV position.

The backrest of the chair is, of course, positioned at the rear of the seat and includes a backrest link 50 fixed to the backrest frame 55 and pivoted at 52 to the rear end portion of seat link 20. Backrest frame 55 is covered by suitable upholstery 56. As shown in FIG. 3, the lower end of backrest link 50 is pivotally connected at 62 to the rear of a thrust link 54 having its forward end pivotally connected at 63 to the rear carrier link 32 at a lower portion thereof below pivot 36. Thrust link 54 functions to pivot the rear carrier link 32 when the chair is moved to advanced reclining position by exerting pressure against the backrest to pivot backrest link 50 rearwardly about pivot 52 which drives thrust link 54 forwardly to pivot carrier link 32 clockwise (as shown in FIG. 2) and which causes the seat to be moved upwardly and rearwardly relative to the base link.

The above movement is achieved after the chair is in TV position shown in FIG. 3. However, when the chair is in the closed position shown in FIG. 2, movement of the backrest relative to the seat is prevented by a sequencer link 41 in accordance with another aspect of the present invention. Sequencer link 41 has its upper end pivotally connected at 43 to a forward portion of front carrier link 30 and in its lower portion a slide 82 receives a pin 84 fixed to the base link 15. When the linkage system is in the closed position shown in FIG. 2, pin 84 will engage in the bottom of slide 82 to prevent movement of the front carrier link 32 and seat link 20 which, of course, will prevent movement between the seat and backrest. However, when the chair moves towards TV position, pin 84 will become spaced (see FIG. 3) from the bottom of slide 82 to allow the advanced reclining movement described above. Note from FIG. 4 that in the fully reclined position, pin 84 engages in the bottom of slot 82.

Figure 4:
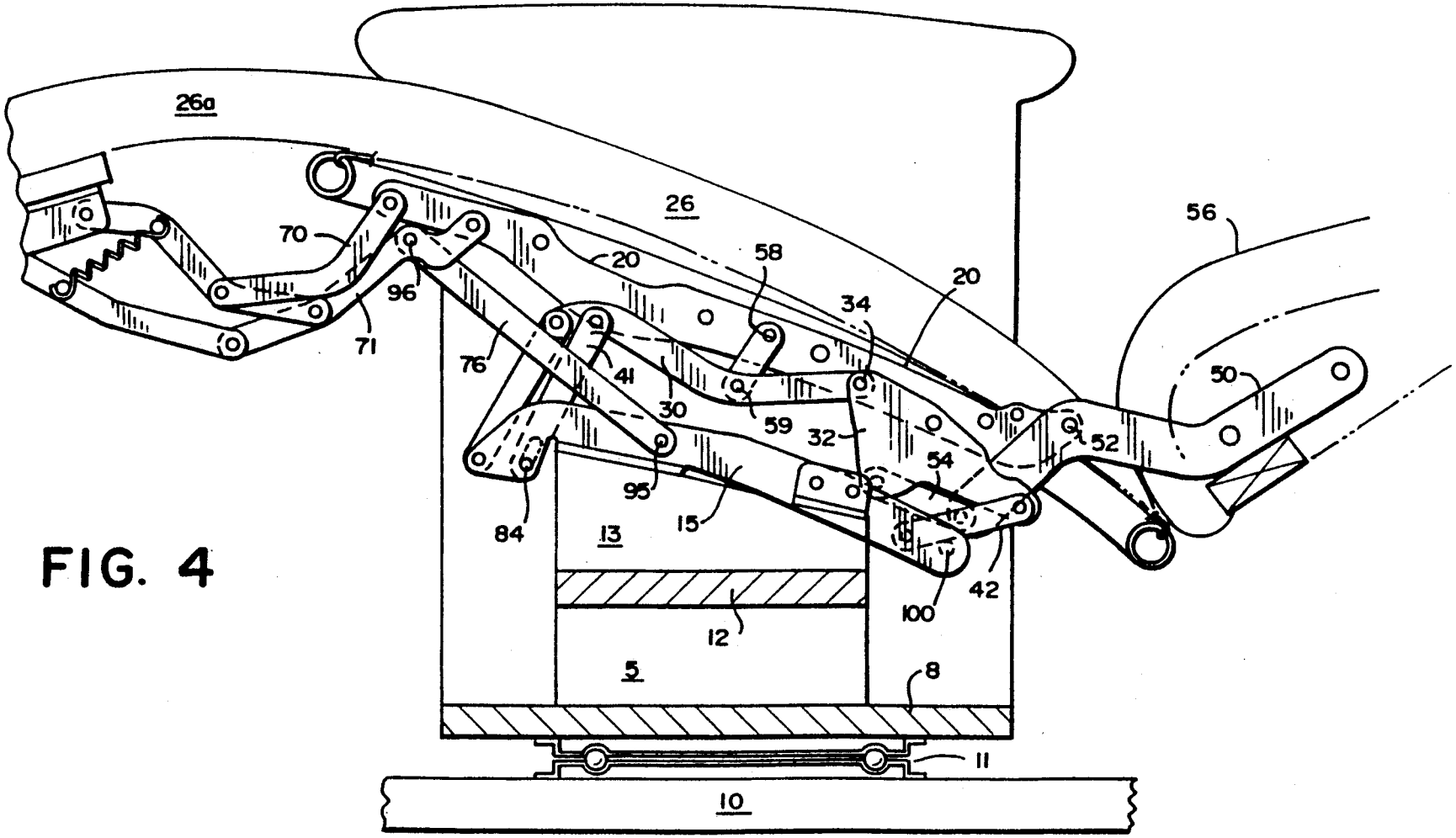
FIG. 4 is a view generally similar to FIG. 3 but with the chair shown in the fully advanced reclining position.

The footrest linkage in the shown embodiment includes a pair of mounting links 70 and 71 having their upper ends pivotally mounted to the seat link 20 at spaced locations at the front of the seat as shown at pivots 70*a* and 71*a*. Links 70 and 71 are pivotally connected to a pair of links 72 and 74 which, in turn, are connected to an ottoman link 75 which is fixed to an ottoman frame shown as a board 27. Link 71 is also pivotally connected at 77 to link 72. The footrest linkage is arranged with respect to the seat such that the ottoman link 71 and board 27, when closed or retracted, will be positioned generally horizontally below the seat and rearwardly of the front of the seat as shown in FIG. 2. The footrest is biased in closed position by a coil spring 90. Also, when the footrest is extended such as shown in FIGS. 3 or 4, the seat and footrest upholstery extends continuously in one layer without interruption or separation at the juncture of the seat and footrest mechanism. This not only provides a highly attractive appearance, it also enhances user comfort by allowing the contour of the seat and footrest upholstery to match the contour of the user.

Actuation of the footrest and chair between the closed position shown in fig. 2 to the open or TV position shown in FIG. 3 is achieved by the occupant grasping the armrests and pushing rearwardly with the back against the backrest. This will cause the seat 20 to move rearwardly relative to the base link 15 while also swinging upwardly at the front and downwardly at the rear to change pitch as shown in FIG. 3. A footrest control link 76 is pivoted at its rear at 95 to the base link 15 and at its front at 96 to footrest mounting link 71. Upon movement of the seat relative to the base rearwardly when moving in the TV position, control link 76 allows the footrest link 71 to pivot towards open position by the action of the seat link 20 thereon. Opening of link 71 causes the entire footrest linkage to move to extended or TV position shown in FIG. 3. In order to retract the footrest to closed position, pressure is applied with the legs on the footrest in conventional manner.

In order to move the chair to an advance reclining position beyond TV position towards full recline position of FIG. 4, the occupant exerts pressure against the backrest and the thrust link 54 pivots the rear carrier link 32 clockwise as shown in FIG. 3 which causes the front carrier link 30 to pivot counterclockwise about pivot 34. The result is that the pitch and elevation of the seat relative to the base is increased in the full recline position shown in FIG. 4. Such action not only places an occupant in a comfortable position but it also establishes a balance in the linkage enabling the reclining position to be maintained by the balance of the linkage under the occupant's weight. A stop 100 is fixed to base link 15 to engage mounting link 42 to determine the full recline position shown in FIG. 4 To return the chair to TV position of FIG. 3 from an advance reclining position, the occupant merely removes pressure from the backrest whereupon the redistribution of the occupant's weight will return the linkage to the TV position shown in FIG. 3. The position of the carrier links 30, 32 when the mechanism is in the closed or TV position, is determined by stops 86 and 87 fixed to the seat link 20 and engageable with the carrier links 30, 32 as shown in FIGS. 2 and 3.

Figure 5:
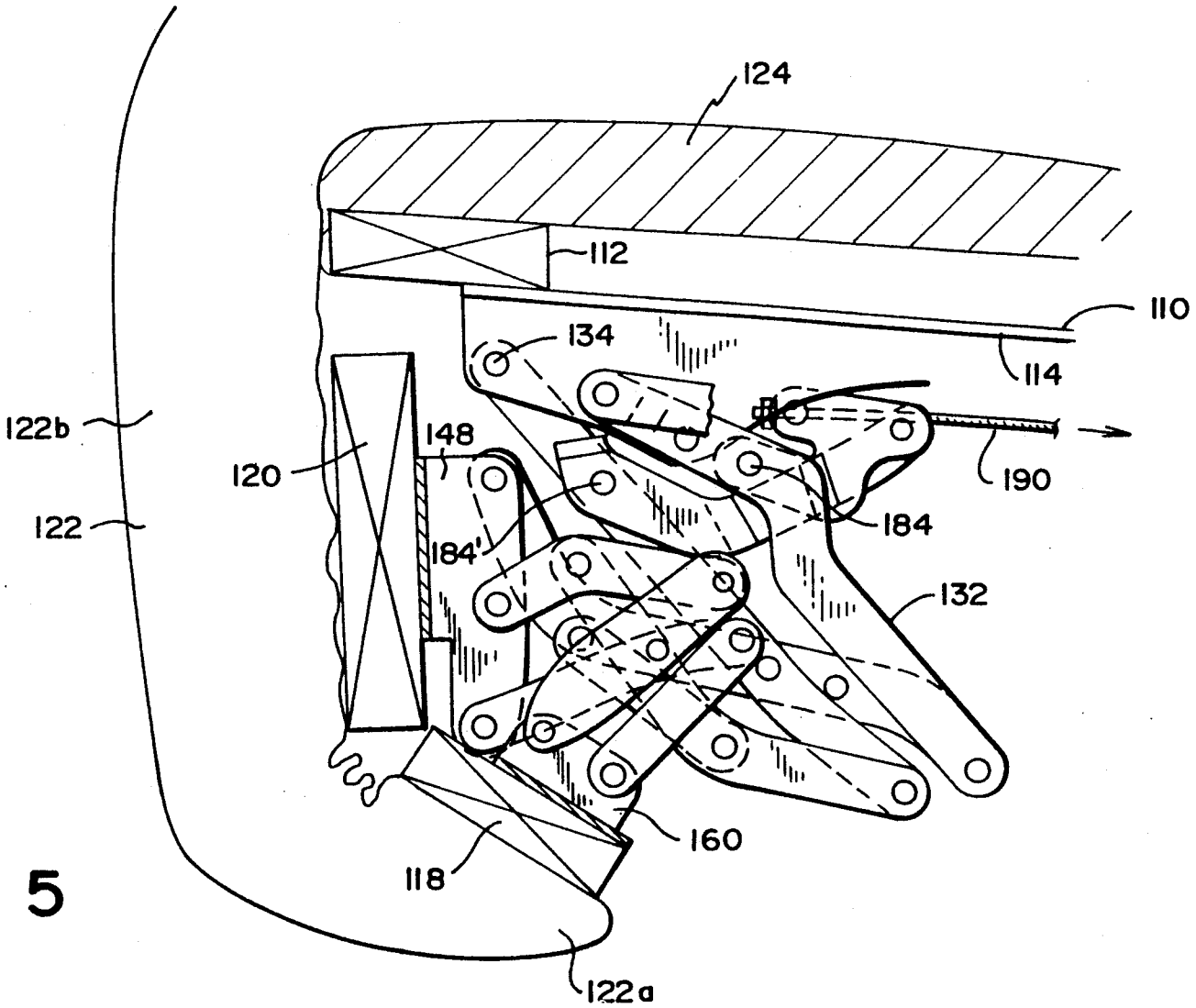
FIG. 5 is a side elevational view with portions broken away of a footrest system constituting another embodiment of the present invention and shown with the footrest in closed position.
Figure 6:
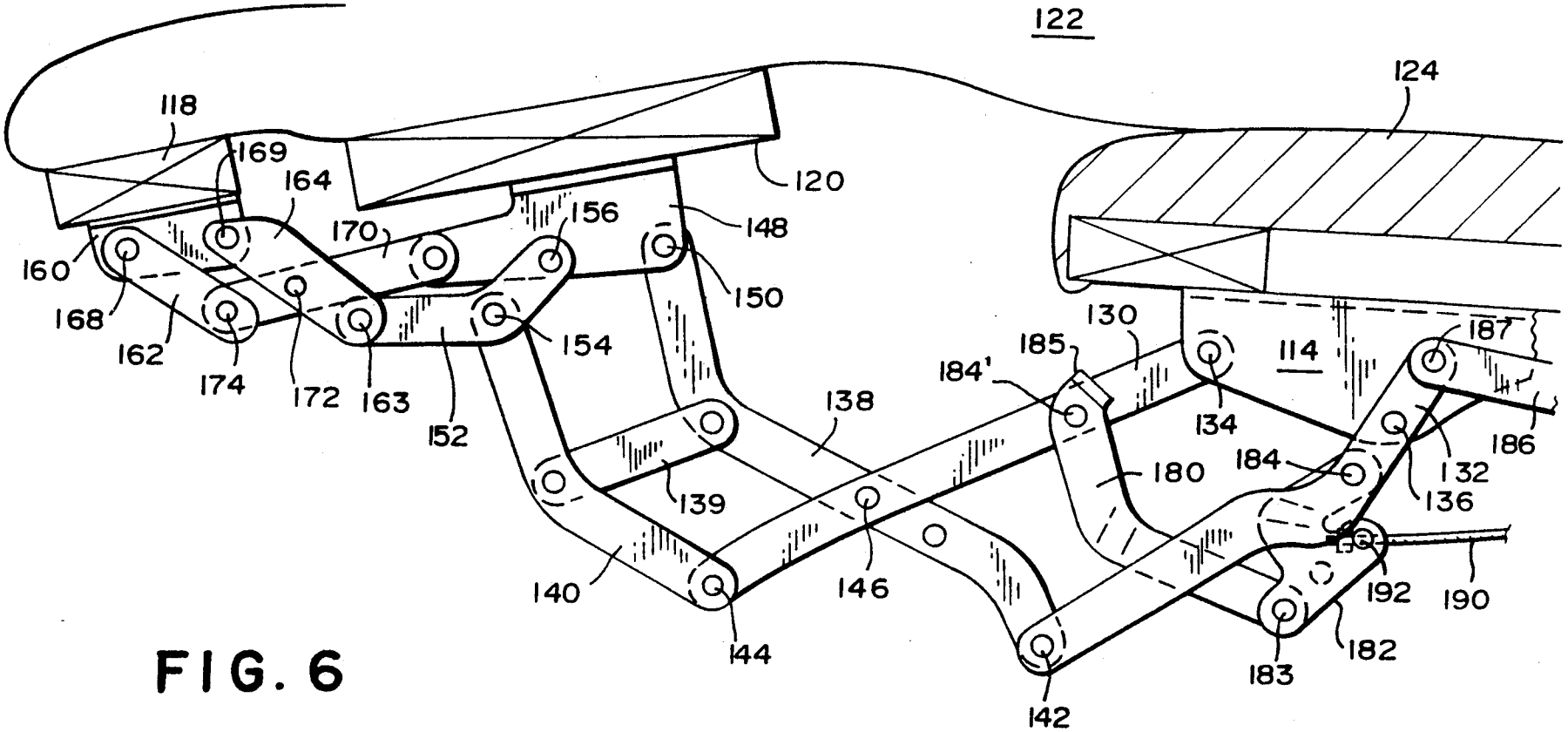
FIG. 6 is a view generally similar to FIG. 5 but showing the footrest in extended position.

Referring now to FIGS. 5 and 6, there is shown another embodiment of the footrest system of the present invention applied to a recliner chair having a seat frame including a siderail 110 and a frontrail 112 mounted to a seat link 114 as shown in FIG. 5. In this embodiment, the footrest frame includes two portions (two ottoman boards) 118 and 120 shown in the closed position in FIG. 5 and in the open or extended position in FIG. 6. As in the above described embodiment, a cover or upholstery 122 is connected or otherwise secured to the ottoman board 118 and extends continuously from the ottoman board 118 to the seat to which it is also connected or secured. In the specific embodiment shown, the upholstery 122 includes an outer covering layer and any suitable padding and furthermore below the upholstery layer 122 another layer of padding 124 may be provided as indicated in FIGS. 5 and 6. In the extended position of the footrest such as when the chair is in the TV position or in any advanced reclining positions, the upholstery 122 extends continuously from the seat of the chair to the second ottoman board 118 providing a continuous leg and foot support surface which is also attractive due to its continuous planar surface effect and smooth lines. In the closed position of the footrest when the chair is in the closed position, the lower ottoman board 118 will pull the upholstery layer 122*a* such that it extends downwardly at the front of the chair below the seat and then inwardly below the front edge of the seat as shown in FIG. 5. The footrest mechanism as well as the seat mechanism and the upholstery are designed such that in the extended position of the footrest such as shown in FIG. 6, the upholstery layer 122 will extend continuously between the seat and the lower ottoman board 118 without drooping or sagging. At the same time the upholstery layer 122 will still wrap around the front of the seat as shown in FIG. 5 when the footrest is retracted.

Although the linkage mechanism for mounting and actuating the seat and backrest are not shown in FIGS. 5 and 6 any suitable mechanism may be employed for example see applicant's prior U.S. Pat. No. 4,740,031 issued Apr. 26, 1988 and entitled MECHANISM FOR A RECLINING CHAIR OR SOFA MODULE the disclosure of which is incorporated in its entirety into the present application and made a part hereof.

In accordance with another aspect of the present invention, a novel footrest linkage is employed for mounting the footrest ottoman to the chair for movement between the retracted and extended positions shown in FIGS. 5 and 6. In the preferred embodiment shown, the footrest linkage includes footrest mounting links 130 and 132 pivotally mounted by pivots 134 and 136 to the seat mounting link 114 as best shown in FIG. 6. In the fashion of a lazy tong linkage, mounting links 130 and 132 are pivotally connected to links 138 and 140 by means of pivots 142 and 140 while mounting link 130 is also pivotally connected by pivot 146 to link 138. In addition a control link 139 is pivotally mounted at its opposite ends to intermediate portions of links 138 and 140 as best shown in FIG. 6. Ottoman board 120 is suitably secured to a bracket link 148 which in turn is pivotally mounted by pivot 150 to the outer end portion of link 138. Bracket link 148 is mounted to the link 140 by means of a crank link 152 having one end mounted by pivot 156 to the bracket link 148 and an intermediate portion pivotally mounted by pivot 154 to link 140. It will be seen that the linkaqe including bracket link 148 links 138, 140 link 152 (the portion between pivots 154 and 156) and link 130 (the portion between pivots 144 and 146) provide a five bar linkage for not only mounting the ottoman board for movement and actuation between its positions, but also for mounting and actuating the other ottoman board 118 between its positions. In this latter regard, in the specific embodiment shown, ottoman board 118 is secured to a bracket link 160 which is mounted to a link 170 by means of links 162 and 164. Link 162 is pivotally connected at pivot 168 to bracket link 160 and pivotally connected by pivot 174 to one end of link 170. Link 164 is pivoted by pivot 169 to the bracket link 160 and has its opposite end pivoted by pivot 163 to crank link 152.

The aforementioned linkage allows the ottoman board 118 to be swung from its retracted position shown in FIG. 5 downwardly, forwardly and upwardly into its extended position of FIG. 6 without the ottoman board 118 or the surrounding upholstery section 122*a* striking the floor. This is uniquely achieved without requiring the seat height of the chair to be increased or without sacrificing the distance of extension of the footrest in the TV position shown in FIG. 6. At the same time the ottoman board 118 still is able to perform its function of wrapping the upholstery layer 122 about the front of the seat and below the front of the seat as in the preferred embodiment. Although in the preferred embodiment the outermost section 122*a* of the upholstery 122 adjacent the ottoman board is shown as being located under the seat, in other embodiments the outer most section or end of the upholstery layer may terminate short of reentry under the seat as long as the midsection 122*b* of the upholstery extends downwardly below the level of seat as shown in FIG. 5.

In accordance with another aspect of the present invention, the footrest is held in the retracted or closed position shown in FIG. 5 by means of a lock mechanism which constitutes an improvement over the lock mechanism disclosed in applicant's prior U.S. Pat. Nos. 4,350,386 issued Sept. 21, 1982, 4,350,387 issued Sept. 21, 1982, and 4,418,957 issued Dec. 6, 1983 and entitled RECLINING CHAIR WITH IMPROVED ACTUATION. The disclosures of each of these patents are hereby incorporated by reference into the subject application as part hereof.

In the presently described embodiment of FIGS. 5 and 6, the locking mechanism includes a pair of locking links 180 and 182 which may also be termed "knuckle links". Locking links 180 and 182 are respectively pivotally mounted to footrest mounting links 130 and 132 by pivots 184 and 184'. In addition knuckle links 180 and 182 are pivotally interconnected to each other by pivot 183 as best shown in FIG. 6. In the closed position of the footrest shown in FIG. 5, the pivots 184, 184' and 183 will be substantially aligned on a straight line and the locking links 180 and 182 will prevent movement of the footrest linkaqe to extended position. This in turn of course prevents the entire seat mounting linkage from moving to the TV position. Depending on the particular seat linkage system employed, the footrest linkage may be urged to extended position either by gravity derived from the weight of the occupant of the seat or by a spring mechanism. In either case the locking links 180 and 182 when in the position shown in FIG. 5 will prevent opening of the footrest linkage as long as the pivots 184, 184' and 183 are in alignment or on center as generally shown in FIG. 5. In order to release the footrest linkage to allow the footrest to move to extended position, it is necessary to move the locking links 180 and 182 out of the position shown in FIG. 5 so that the pivots 183, 184 and 184, are no longer on center. This may be done in any suitable manner by rotating the locking link 182 clockwise as viewed in FIG. 5 in which event the biasing force imposed on the footrest linkage through the link 186 pivotally connected at 187 to the footrest mounting link 132 as shown in FIG. 6 will be effective to swing the footrest mounting links 130 and 132 clockwise as viewed in FIGS. 5 and 6 to extend the footrest mechanism.

In order to move the locking links 180 and 182 to release their hold on the footrest linkage, any suitable mechanism may be employed for rotating the locking links 180 and 182 clockwise from the closed or holding position of FIG. 5 to the open or released position of FIG. 6. In the specific embodiment shown, a cable 190 is connected to link 182 at 192 such that in the closed position of the footrest linkage shown in FIG. 5, once the cable 190 is pulled in the direction of the arrow, it will rotate the locking link 182 in a clockwise direction. Although not shown, cable 190 may be connected to a pushbutton actuator for initiating the release of the locking links. In an alternative embodiment not shown, a link may be pivotally connected to the locking link 182 to rotate the same clockwise out of the position of FIG. 5 for releasing the footrest mechanism. As noted above, once the locking links 180 and 182 are moved to the released position, the footrest linkage is moved to the extended position by either gravity and/or a spring mechanism which impose a force acting through link 186 to rotate the footrest mounting link 132 in a clockwise direction as viewed in FIG. 6.

In accordance with another feature of the present invention, one of the locking links, preferably 180, is employed for attaching a torque member or torque tube at 185 to extend between the linkage mechanisms on opposite sides of the chair. It will be understood that the associated recliner chair will include linkage mechanisms on the opposite sides of the chair which mechanisms are mirror images of each other and need not be described in duplicate. The torque tube will extend from a flanged portion 185 of locking link 180 to a similar portion on the locking link at the opposite side of the chair.

Other various modifications of the present invention will become apparent to those having ordinary skill in the art, however such modifications will not depart from the scope of the present invention indicated in the appended claims.

What is claimed is:

1. A recliner chair comprising in combination a basic support, a seat and backrest, a linkage system mounting the seat and backrest on the basic support, a footrest linkage mounted at the front of the chair for movement between retracted and extended positions, a footrest frame connected to the footrest linkage to move between a retracted position below the seat and inwardly of the front end of the seat and an extended position projecting forwardly from the front end of the seat, a second footrest frame connected to the footrest linkage between the first frame and the seat, a layer of upholstery overlying and connected to the seat and extending over the second frame and to the first footrest frame while being connected to the first frame, said upholstery layer extending from the seat to the first footrest frame when the footrest is in extended position to provide a leg and foot support surface, and extending about the front end of the seat and below the seat when the footrest is in retracted position, said upholstery layer being exposed to view at the front of the chair below the seat when the footrest is in retracted position.

2. The recliner chair defined in claim 1 further including means including a pair of locking links pivotally mounted on the footrest linkage and interconnected to each other for releasably holding the footrest linkage in retracted position.

3. The recliner chair defined in claim 2 wherein said footrest linkage includes a five bar linkage for actuating said footrest frames.

* * * * *